US010782101B2

(12) United States Patent
Sabaldan Elpedes et al.

(10) Patent No.: US 10,782,101 B2
(45) Date of Patent: Sep. 22, 2020

(54) POWERED MOUNT FOR FIREARM

(71) Applicant: Trijicon, Inc., Wixom, MI (US)

(72) Inventors: Jerry Glen Sabaldan Elpedes, Milford, MI (US); Norman Joseph Nazaroff, Novi, MI (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 16/045,146

(22) Filed: Jul. 25, 2018

(65) Prior Publication Data

US 2020/0033095 A1 Jan. 30, 2020

(51) Int. Cl.
*F41G 11/00* (2006.01)

(52) U.S. Cl.
CPC ..... *F41G 11/003* (2013.01)

(58) Field of Classification Search
USPC ..... 42/146, 90, 84
See application file for complete search history.

(56) References Cited

U.S. PATENT DOCUMENTS 5,669,174 A * 9/1997 Teetzel ..... F41A 9/62 356/5.01
7,627,975 B1 12/2009 Hines
8,028,460 B2 10/2011 Williams
8,151,505 B2 * 4/2012 Thompson ..... F41G 11/003 42/84
8,296,991 B1 10/2012 Chung
8,402,683 B2 3/2013 Cabahug et al.
9,074,846 B2 7/2015 Mencotti
9,200,867 B1 12/2015 Swan
9,383,167 B1 * 7/2016 Connolly ..... F41G 11/003
9,602,730 B2 3/2017 Volfson
9,784,536 B2 * 10/2017 Boswell ..... F41G 11/004
2012/0064387 A1 * 3/2012 Kim ..... H01M 2/021 429/158
2013/0061504 A1 * 3/2013 Malherbe ..... F41G 11/003 42/84
2013/0104438 A1 5/2013 Hines
2013/0104439 A1 5/2013 Hines
2013/0333266 A1 12/2013 Gose et al.
(Continued)

FOREIGN PATENT DOCUMENTS

EP 1772695 A1 4/2007
EP 2975356 A1 1/2016
(Continued)

OTHER PUBLICATIONS http://soldiersystems.net/2017/02/13/wilcox-industries-fusion-system/; Soldier Systems—an Industry Daily; Feb. 13, 2017; 7 pages [accessed on Jul. 24, 2018].
(Continued)

*Primary Examiner* — Reginald S Tillman, Jr.
(74) *Attorney, Agent, or Firm* — Harness, Dickey & Pierce, P.L.C.

(57) ABSTRACT

A powered mount for a firearm includes a housing for receiving a battery. The housing has a first surface engaging a firearm and a second surface engaging an external device. A positive contact sub-assembly contacts a positive terminal of the battery. A negative contact cooperates with the positive contact sub-assembly to sandwich the battery in the housing. A power output transfers electrical current from the battery to the external device.

15 Claims, 6 Drawing Sheets

(56) References Cited

U.S. PATENT DOCUMENTS

| | | | | |
|---|---|---|---|---|
| 2014/0059911 | A1* | 3/2014 | Oh | F41C 23/22 42/16 |
| 2014/0305022 | A1 | 10/2014 | Chung | |
| 2015/0128472 | A1 | 5/2015 | Theisinger et al. | |
| 2015/0247703 | A1 | 9/2015 | Teetzel et al. | |
| 2015/0308787 | A1* | 10/2015 | Cheng | F41G 1/34 42/126 |
| 2016/0033232 | A1* | 2/2016 | Cheng | F41G 1/345 42/114 |
| 2016/0172876 | A1 | 6/2016 | Stewart et al. | |
| 2017/0155269 | A1 | 6/2017 | Swift | |
| 2017/0176140 | A1 | 6/2017 | Harrison | |
| 2017/0205202 | A1 | 7/2017 | Teetzel et al. | |
| 2017/0241742 | A1 | 8/2017 | Davidson et al. | |

FOREIGN PATENT DOCUMENTS

| | | | |
|---|---|---|---|
| FR | 3029616 | A1 | 6/2016 |
| WO | WO-2016/126311 | A1 | 8/2016 |
| WO | WO-2018-013484 | A1 | 1/2018 |

OTHER PUBLICATIONS www.dtic.mil/ndia/2009/infantrysmallarms/wednesdaysessionvTorbjoern.pdf; Powered Rail—Presentation to Intl Infantry & Joint Service Small Arms System Symposium, May 20, 2009 (9 pages); [accessed on Jul. 24, 2018].

www.tworx.com/technology; I-Rail; 2017 T-Worx Holdings, LLC; pp. 1-11 [accessed on Jul. 24, 2018].

United Kingdom Combined Search and Examination Report for Patent Application No. GB1905420.4 dated Oct. 18, 2019 (7 pages).

Swedish Office Action and Search Report for Patent Application No. SE 1950677-3, dated Dec. 19, 2019 (10 pages).

* cited by examiner

POWERED MOUNT FOR FIREARM

FIELD

The present disclosure relates to a powered mount for a firearm, and more specifically to a powered mount for mounting optics and/or accessories to a firearm.

BACKGROUND

This section provides background information related to the present disclosure which is not necessarily prior art.

Optic mounts are provided for mounting an optic to a firearm platform. Such optic mounts generally have one surface that mates with a portion of the firearm and a second, opposing surface that mates with an optic for aiming the firearm. The optic mount spaces the optic from the firearm to align with a user's eye. Currently, optic mounts in the field simply perform the function of connecting an optic to a firearm.

SUMMARY

This section provides a general summary of the disclosure, and is not a comprehensive disclosure of its full scope or all of its features.

An example powered mount for a firearm according to the present disclosure includes a housing for receiving a battery. The housing has a first surface engaging a firearm and a second surface engaging an external device. A positive contact sub-assembly contacts a positive terminal of the battery. A negative contact cooperates with the positive contact sub-assembly to sandwich the battery in the housing. A power output transfers electrical current from the battery to the external device.

In the powered mount, the first surface of the housing may be opposite the second surface of the housing.

The external device may be an optical device.

The powered mount may further include a second power output transferring power from the battery to an additional accessory.

The second power output may be disposed on a third surface of the housing, between the first surface and the second surface.

The additional accessory may be a flashlight, a laser, a camera, a counter, a global positioning system, a range finder, a wind sensor, a display, or an infrared (IR) illuminator.

In the powered mount, the power output may be a surrogate contact sub-assembly.

In the powered mount, the power output may be a port.

In the powered mount, the positive contact sub-assembly may include an insulator and a positive contact. The positive contact may engage a positive terminal of the battery and transfer electrical current from the battery to the power output.

The powered mount may further include a power conditioning system for conditioning electrical current from an external power source for the external device.

The power conditioning system may include at least one power conditioner having at least one element from the group of a transistor, a diode, a resistor, a capacitor, and an inductor.

The powered mount may further include a power input port configured to electrically connect with an external power source. The battery may be electrically connected to the power input port and may be configured to be recharged by the external power source.

Another example powered mount for a firearm according to the present disclosure includes a housing for mounting an external device. A power input port on a surface of the housing receives an electrical current from an external power source. A power conditioning system conditions the electrical current from the external power source. A power output transfers the conditioned electrical current from the power conditioning system to the external device.

In the powered mount, the power conditioning system may include at least one power conditioner having at least one element from the group of a transistor, a diode, a resistor, a capacitor, and an inductor.

The powered mount may further include a positive contact sub-assembly and a negative contact cooperating with the positive contact sub-assembly to sandwich a battery in the housing.

In the powered mount, the battery may be configured as a back-up power source for the external power source.

The external device may be a powered optic.

The powered mount may further include a power storage unit for storing electrical power from the external power source.

In the powered mount, the power output may include a positive contact sub-assembly and a surrogate contact sub-assembly.

The powered mount may further include a second power output transferring electrical current from the power conditioning system to a second external device.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Optic mounts currently in the industry are generally designed to be an implement that mounts an optic to a firearm platform. The optic mounts are not meant to supply and/or condition power to a device, house a battery, or tap into an alternative power source. As described herein, a powered mount is provided which integrates into an optic mount a means to deliver electrical current to the optic using a battery or other power source, such as a powered rail. The mount may condition the electrical current it supplies to the optic via surrogate battery contacts or an auxiliary power port.

Additionally, accessories such as a flashlight, laser, camera, counter, global positioning system, range finder, wind sensor, display, or infrared (IR) illuminator, or other devices useful in a firearm-mounted configuration currently are individual units that each include a mount for the device. The current devices each take up space and include their own power source and means for control. The powered mount disclosed herein may include a housing used as a platform to house and control accessories such as a flashlight, laser, camera, counter, global positioning system, range finder, wind sensor, display, or infrared (IR) illuminator, or other devices useful in a firearm-mounted configuration, providing a single, elegant, cohesive, and compact package.

Figure 1:
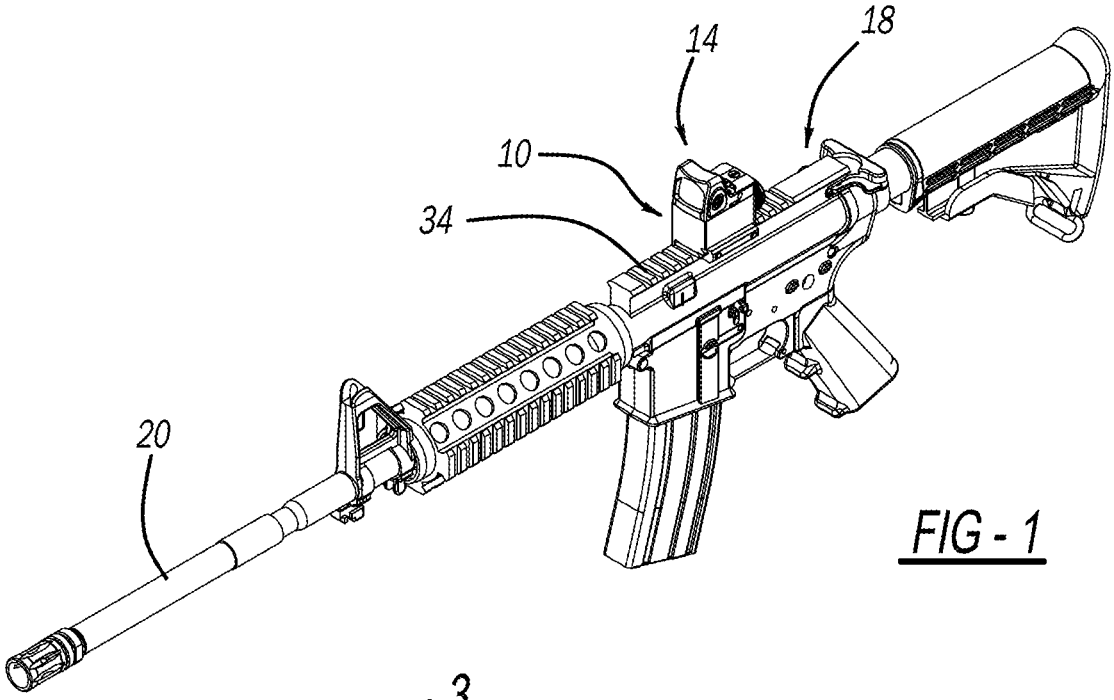
FIG. 1 is a perspective view of a powered mount assembled to a firearm and an optical device according to the present disclosure.
Figure 2:
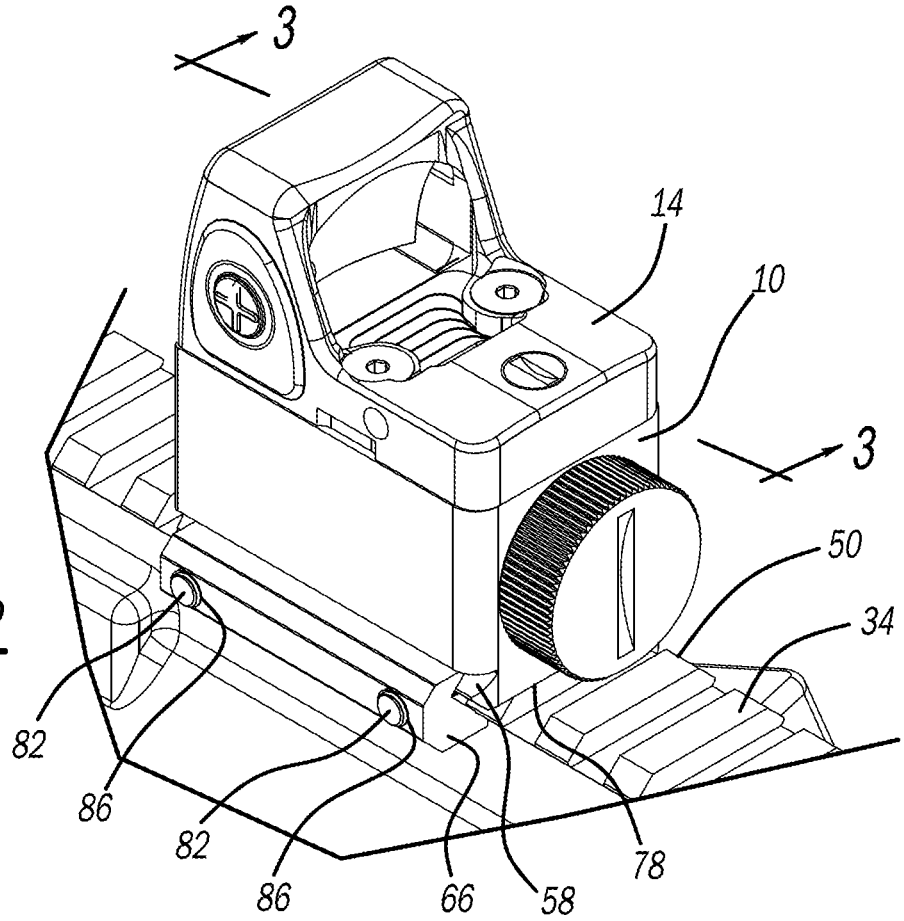
FIG. 2 is another perspective view of the powered mount assembled to the firearm and the optical device according to the present disclosure.
Figure 3:
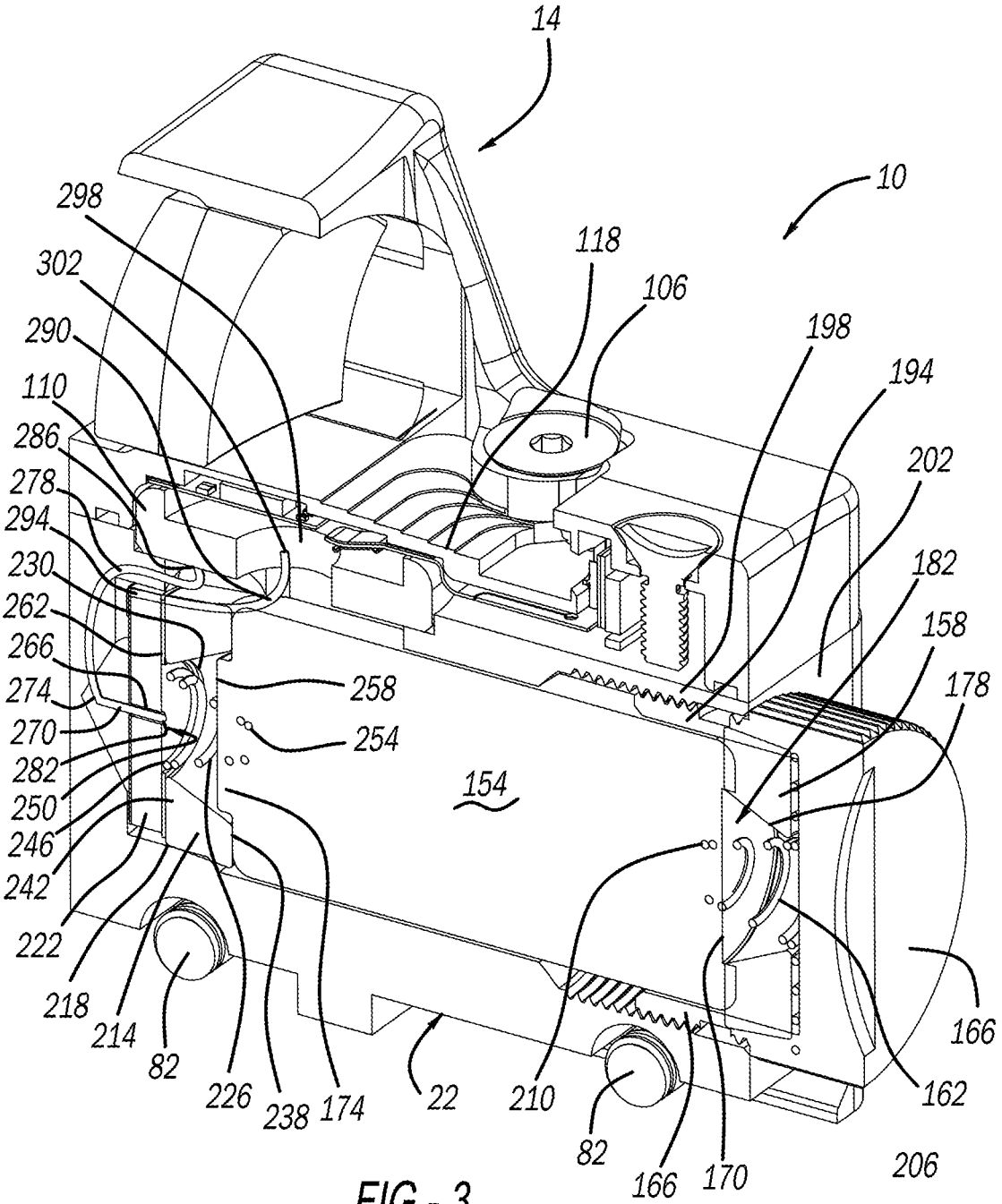
FIG. 3 is a cross sectional view of the powered mount assembled to the optical device according to the present disclosure.
Figure 4:
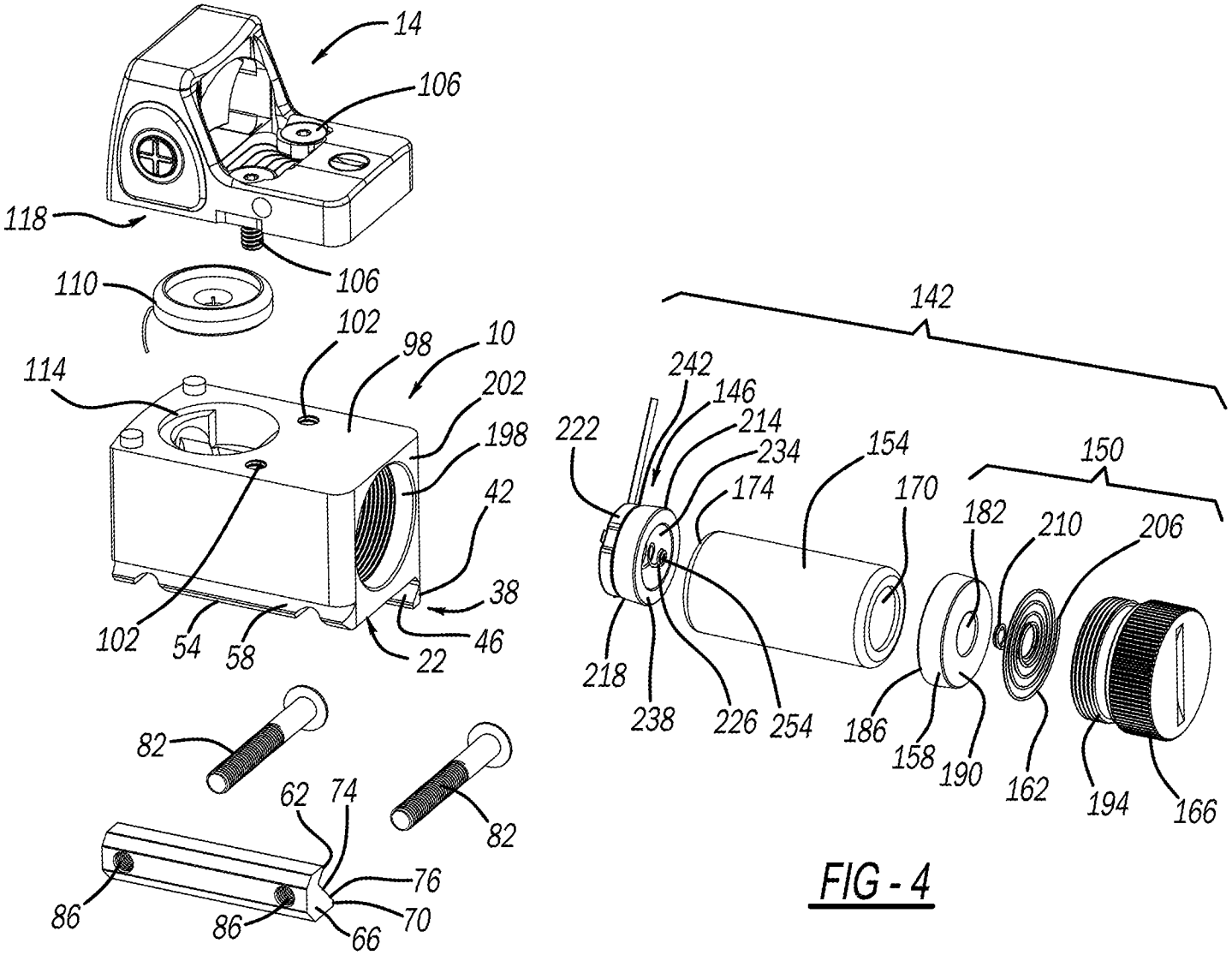
FIG. 4 is an exploded view of the powered mount and optical device according to the present disclose.

As illustrated in FIG. 1, a powered mount 10 is provided for powering and attaching an optical device 14, or optic, to a firearm (for example, a rifle or handgun) or other weapon 18. The optical device 14 may be any optical device for aligning a barrel 20 of the firearm 18 relative to a target (i.e., aiming the firearm). For example, as shown in FIGS. 1 and 2, the optical device 14 may be a Trijicon RMR® (Ruggedized Miniature Reflex) sight designed and manufactured by Trijicon, Inc. Additionally, the optical device 14 may be a Trijicon MGRS® (Machine Gun Reflex Sight), MRO® (Miniature Rifle Optic), Trijicon® Reflex sight, SRS® (Sealed Reflex Sight), ACOG® (Advanced Combat Optical Gunsight), Accu Point®, Accu Power®, TARS® (Tactical Advanced Riflescope), VCOG® (Variable Combat Optical Gunsight), IR-HUNTER®, REAP-IR™, IR, IR-PATROL™, SNIPE-IR™, Bright & Tough™ night sights or suppressor night sights, HD™ night sights, HD XR™ night sights, or TrijiDot® sights, all designed and manufactured by Trijicon, Inc. Further, the optical device 14 may be any optical device for mounting to a firearm.

Referring to FIGS. 1-4, the powered mount 10 may include a first, or bottom, surface 22 for mounting the powered mount 10 to the firearm 18. The powered mount 10 may engage with a slide, a top surface, or a rail 34 of the firearm 18. The first surface 22 may include a projection 38 extending from one longitudinal side 42 of the first surface 22 for securing the powered mount 10 to the firearm 18. The projection 38 may have a sloped inner edge 46 for mating with an edge 50 of the top surface, or rail, 34 of the firearm 18. An opposing longitudinal edge 54 of the first surface 22 includes a channel 58 extending along its length. The channel 58 may be "V"-shaped, "U"-shaped, squared, etc. for receiving a first side 62 of a rail 66. The rail 66 may extend the length of the first surface 22 and may include the first side 62 and a second side 70 which define a channel 74 therebetween. An inner edge 76 of the second side 70 may be sloped similar to (but mirrored to) the sloped inner edge 46 of the projection 38 for mating with an opposing edge 78 of the top surface, or rail, 34 of the firearm 18. The projection 38 and rail 66 may cooperate to clamp or secure the powered mount 10 on the firearm 18. One or more fasteners 82 may extend through apertures (not shown) in the projection 38 and be threaded into apertures 86 in the rail 66 to clamp and secure the powered mount 10 onto the firearm 18. Therefore, the fasteners 82 prevent the powered mount 10 from moving relative to the firearm 18.

Figure 6A:
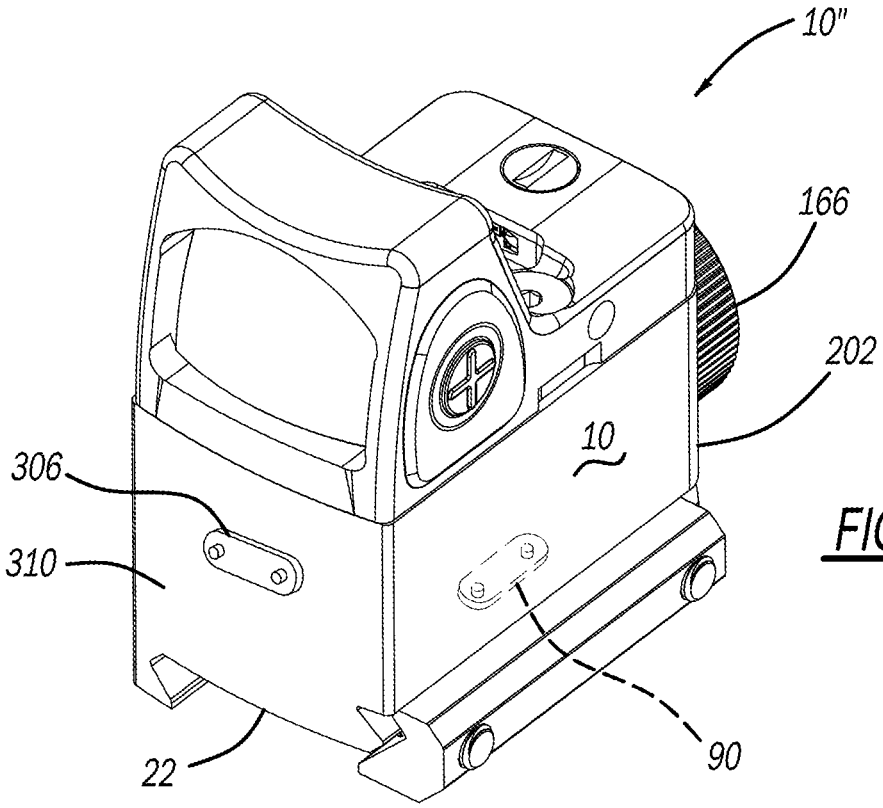
FIG. 6A is a perspective view of another embodiment of the powered mount and optical device according to the present disclosure.

In some configurations, the powered mount 10 may cooperate with a powered rail to deliver electrical current to the optical device 14 (further described below). In these configurations, for example as shown in FIG. 6A, the first surface 22 may include a power input port 90 that electrically connects to a plurality of contacts or a power output port 94 (FIG. 6B) on the firearm 18.

While the powered mount 10 is illustrated and described as being separate from the firearm 18, it is understood that the powered mount 10 may be integral with the firearm 18. For example, the powered mount 10 may be a portion of, and integral with, the slide, the top surface, or the rail 34 of the firearm 18 such that the powered mount 10 and the slide, the top surface, or the rail 34 are a single piece.

The powered mount 10 may further include a second surface 98 which opposes the first surface 22 for attaching the optical device 14 to the powered mount 10. The second surface 98 may include bores 102 for receiving fasteners 106 attaching the optical device 14 to the second surface 98. A surrogate contact sub-assembly 110 (further described below) may be disposed in an aperture 114 in the second surface 98 which electrically connects a power source (further described below), for example a battery, a power storage unit, or conditioned electrical current from an external device, of the powered mount 10 to the optical device 14. The optical device 14 may include a power contact 118 which is electrically connected to the surrogate contact sub-assembly 110 for receiving electrical current.

Figure 5A:
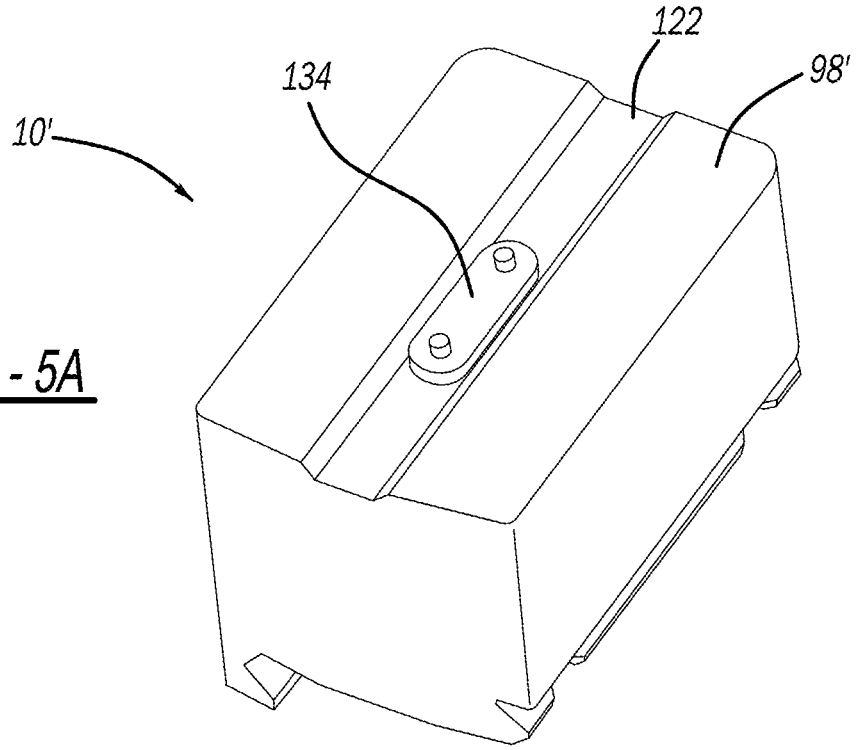
FIG. 5A is a perspective view of another embodiment of the powered mount according to the present disclosure.
Figure 5B:
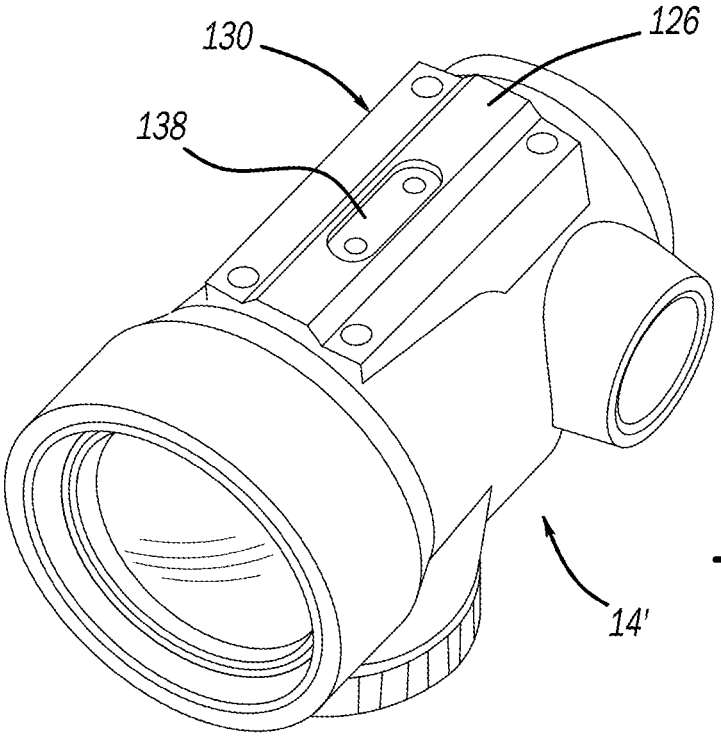
FIG. 5B is a perspective view of an optical device that engages the powered mount of FIG. 5A.

An alternative embodiment of a powered mount 10' and an optical device 14' is illustrated in FIGS. 5A and 5B. Powered mount 10' and optical device 14' may include the same or similar components as powered mount 10 and optical device 14, and, as such, only the different components are labeled and discussed here. In an alternative power connection, a second surface 98' of the powered mount 10' may include a channel 122 which receives a ridge 126 in a base 130 of the optical device 14' for mating the optical device 14' with the powered mount 10'. The channel 122 may include a power output port 134 which electrically connects to a power input port 138 on the ridge 126 of the optical device 14' for supplying electrical current to the optical device 14'.

While multiple configurations for connecting the powered mount 10, 10' to the firearm 18 and the optical device 14, 14' are illustrated in the Figures, it is understood that any mounting configuration for retaining the optical device 14 on the powered mount 10 and retaining the powered mount 10 on the firearm 18 is applicable.

Referring again to FIGS. 3 and 4, the powered mount 10 may house a battery and power conversion system 142 for supplying electrical current to the optical device 14. The battery and power conversion system 142 may include a positive contact sub-assembly 146 and a cap sub-assembly 150 that sandwich a battery 154 within the powered mount 10. The cap sub-assembly includes a first ring 158, a first spring 162, and a cap 166 and contacts a negative end 170 of the battery 154 opposite a positive end 174. The first ring 158 is cylindrically-shaped with angled inner walls 178 defining an aperture 182 extending a length of the first ring. The angled inner walls 178 decrease in diameter along the first ring's 158 length from a first, battery-end 186 of the first ring 158 to a second, cap-end 190 of the first ring 158.

The cap 166 includes a threaded protrusion 194 that secures the battery and power conversion system 142 in the powered mount 10 by threading into a threaded aperture 198 on an end surface 202 of the powered mount 10. A first end 206 of the first spring 162 is retained between the first ring 158 and the cap 166 and a second end 210 of the first spring 162 passes through the aperture 182 in the first ring 158 to contact the negative end 170 of the battery 154 as a negative contact.

The positive contact sub-assembly 146 includes a second ring 214, an insulated disc 218, a pin support disc 222, and a second spring 226 and contacts the positive end 174 of the battery 154. The second ring 214 is cylindrically-shaped with angled inner walls 230 defining an aperture 234 extending a length of the second ring 214. The angled inner walls 230 decrease in diameter along the second ring's length from a first, battery-end 238 of the second ring 214 to a second, insulated-disc end 242 of the second ring 214.

The insulated disc 218 caps the second end 242 of the second ring 214 and cooperates with the second ring 214 to form a cap-like structure on the positive end 174 of the battery 154. The second spring 226 is disposed within the aperture 234 in the second ring 214, with a first end 246 of the second spring contacting a first surface 250 of the insulated disc 218 and a second end 254 of the second spring 226 contacting the positive end 174 of the battery 154. The battery 154 presses against the second end 254 of the second spring 226 such that a positive terminal 258 of the battery 154 projects into the aperture 234 in the second ring 214. The pin support disc 222 is disposed on a second surface 262 of the insulated disc 218 opposite the first, ring-side, surface 250 and includes an aperture 266 at its center for receiving a pin 270. The pin support disc 222 may be formed of an insulating material to provide an electrical ground for the surrogate contact sub-assembly 110.

The pin 270 is connected to a first end 274 of a first wire 278 and passes through the aperture 266 in the pin support disc 222 and an aperture 282 in the insulated disc 218 to contact the positive terminal 258 of the battery 154. A second end 286 of the first wire 278 is electrically connected to the surrogate contact sub-assembly 110 and provides electrical current thereto. A second, ground, wire 290 connects the pin support disc 222 and insulated disc 218 on a first end 294 with a center 298 of the surrogate contact sub-assembly 110 on a second end 302, providing an electrical ground thereto. As such, the battery 154 is able to transmit electrical current to the surrogate contact sub-assembly 110 for powering the optical device 14.

While the positive contact sub-assembly 146 is described as having the insulated disc 218 and the pin 270, in other embodiments, the positive contact sub-assembly may include other methods of construction, such as a surface mount technology. It is understood that the positive contact sub-assembly may include any of these methods of construction, as long as the positive contact sub-assembly includes a positive contact engaged with the positive terminal 258 of the battery 154.

The surrogate contact sub-assembly 110 may include a conductive plate 110 connected to the second end 286 of the first wire 278 providing the electrical current. The conductive plate 110 may include an aperture at its center 298 which receives the second end 302 of the second wire 290 providing the electrical ground. As such, the surrogate contact sub-assembly 110 provides an electrical contact for transferring electrical current from the powered mount 10 to the powered optic 14.

While the battery and power conversion system 142 is described as including a positive contact sub-assembly 146 and a cap sub-assembly 150 that sandwich the battery 154 within the powered mount 10, other embodiments, such as embodiments having a side-loading battery, may not include the cap sub-assembly 150. These embodiments, instead, include the positive contact sub-assembly 146, a housing that secures and protects the battery 154, and a negative contact.

In some embodiments, the battery 154 and power conversion system may include additional components for modifying, such as amplifying or reducing (stepping down), the electrical current provided by the battery 154, as discussed below. Such components may be similar to the components of the power conditioning system later discussed and may include transistors, capacitors, resistors, diodes, inductors, or other electrical components.

Additional accessories may be mounted to the powered mount 10. For example, a flashlight, laser, camera, counter, or other devices useful in a firearm-mounted configuration may be mounted to the powered mount 10 in addition to the optical device. With reference to FIG. 6A, the powered mount 10" may include a contact 306 on an end surface 310 opposite the end surface 202 having the cap 166 for electrically connecting the additional accessory to the battery 154. A power output port 306 or a surrogate contact sub-assembly (similar to surrogate contact sub-assembly 110) may be disposed at the contact 306 to transfer electrical current out of the powered mount 10". A contact or power input port on the additional accessory may be electrically connected to the power output port 306 or surrogate contact sub-assembly to receive electrical current from the battery 154. Mounting configurations similar to the mounting configurations described with respect to the second surface 98, 98' of the powered mount 10, 10' may be implemented on the end surface 310 to receive the additional accessory.

In other embodiments, additional accessories may be integral with the powered mount 10. For example, the flashlight, laser, camera, counter, global positioning system, range finder, wind sensor, display, or infrared (IR) illuminator, or other devices previously mentioned may be formed integral to the powered mount 10. In these embodiments, the contact 306 or battery 154 may be directly electrically connected to the additional accessory.

Figure 6B:
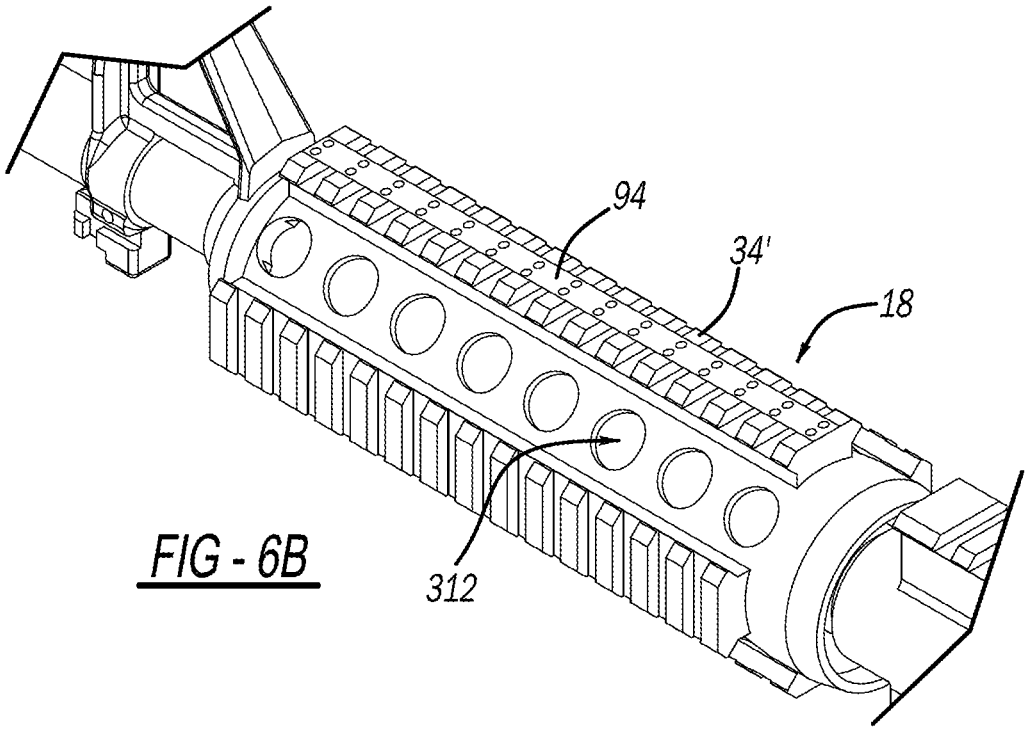
FIG. 6B is a perspective view of a firearm that engages the powered mount of FIG. 6A.
Figure 7:
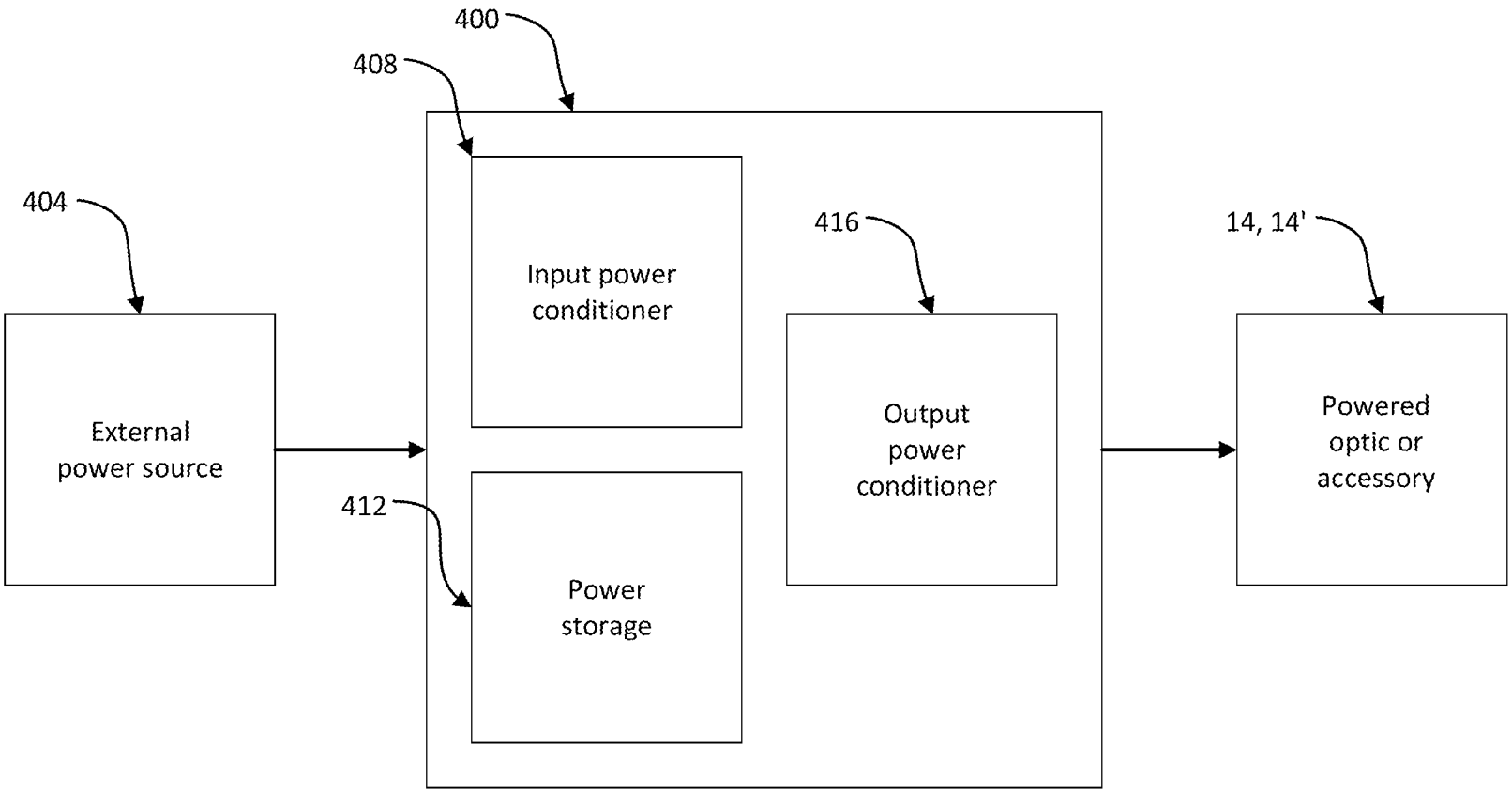
FIG. 7 is an illustration of a power conditioning system.

With reference to FIGS. 6B and 7, and as previously mentioned, the optical device 10, 10', 10" may further include a power conditioning system 400 (FIG. 7) that transmits, stores, and/or conditions electrical current from an external power source 404, such as a powered rail 34' (FIG. 6B), to the optical device 14. In the case of a powered rail 34', the firearm 18 may include a rail 34' housing a battery pack 312 with a plurality of batteries. The batteries 312 may transfer electrical current to one or more contacts 94 positioned along the rail 34'. In the alternative, the batteries 312 may transfer electrical current to a single power output port (similar to power output port 134) on the surface of the rail 34'. In other embodiments, the firearm 18 may house a battery or battery pack in a buttstock, or other location, on the firearm and transfer electrical current to either a plurality of contacts 94 positioned along the surface of the rail 34' or a single power output port positioned on a surface of the rail 34' of the firearm 18.

With reference to FIG. 7, the power conditioning system 400 is illustrated. By conditioning the electrical current from the external power source 404, the powered mount 10, 10', 10" conditions the electrical current into a strength and/or quality that the optical device 14 or other accessory may readily use. In the case of the powered rail 34', the powered mount 10, 10' taps into the rail contacts 94 or rail output port to receive the electrical current for conditioning. In addition to conditioning electrical current supplied in real time, the battery 154 of the powered mount 10, 10' may serve as a battery backup, supplying electrical current to the powered optic 14, 14' or other accessory if there is a power-supply issue with the electrical current from the external power source 404.

The power conditioning system 400 communicates with the external power source 404 to receive input electrical current. The powered mount 10 may include the power input port 90, or an electrical contact, on the first surface 22 that electrically connects to the plurality of contacts 94 or the power output port on the firearm 18 to communicate with and receive electrical current from the external power source 404 or powered rail 34'. Once the externally supplied electrical current is received at the power input port 90, an input power conditioner 408 conditions the electrical current for either storage or transfer to the powered optic 14, 14' or other powered accessory.

The input power conditioner 408 may include one or more of transistors, capacitors, resistors, diodes, inductors, or other electrical components to modify, such as amplify or reduce, or improve the quality of the input power. The input power conditioner may modify the input electrical current to a specified voltage for either storage or transfer to the powered optic 14, 14' or other powered accessory. The input power conditioner may also improve the electrical current quality through, for example, power factor correction, noise suppression, transient impulse protection, etc. The input power conditioner may also work to smooth the sinusoidal wave form and maintain a constant voltage over varying loads.

The conditioned electrical current from the input power conditioner 408 may be stored in a power storage unit, or battery, 412 in the powered mount 10, 10', 10". The storage unit 412 allows for the powered mount 10, 10' to be rechargeable and store power for use either as a primary power source or battery backup power source.

In the case where the input electrical current is conditioned and stored in the power storage unit 412, an output power conditioner 416 conditions the stored electrical current for transfer to the powered optic 14, 14' or other powered accessory. The output power conditioner 416 may include one or more of transistors, capacitors, resistors, diodes, inductors, or other electrical components to modify, such as amplify or reduce, or improve the quality of the stored electrical current. The output power conditioner 416 may modify the stored electrical current to a specified voltage for transfer to the powered optic 14, 14' or other powered accessory.

Once conditioned, either in the input power conditioner 408 or the output power conditioner 416, the electrical current is transmitted through the surrogate contact subassembly 110 or power output port 306 to the power contact 118 or input port on the powered optic 14, 14' or the accessory. The powered optic 14, 14' or accessory then utilizes the electrical current accordingly.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A powered mount for attaching an optical sight to a firearm, the powered mount comprising:

a housing defining an internal space for receiving a battery, wherein the housing has a first surface configured to be removably coupled to a rail of a firearm and a second surface configured to be removably coupled to an optical sight, the housing defining an aperture on a third surface connecting the first surface and the second surface, the aperture providing access to the internal space, and the aperture being selectively closed by a cap;

a positive contact sub-assembly for contacting a positive terminal of the battery;

a negative contact cooperating with the positive contact sub-assembly for sandwiching the battery in the housing, the positive contact sub-assembly, the negative contact, and the battery being aligned along a length of the housing, and the negative contact being housed within the cap; and a power output for transferring electrical current from the battery to a power input on the optical sight, the power output being aligned orthogonal to the length of the housing and overlapping the battery when viewed from the second surface of the housing.

2. The powered mount of claim 1, wherein the first surface of the housing is opposite the second surface of the housing.

3. The powered mount of claim 1, further comprising a second power output for transferring power from the battery to an additional accessory simultaneously.

4. The powered mount of claim 3, wherein the second power output is disposed on a fourth surface of the housing, between the first surface and the second surface and opposite the third surface.

5. The powered mount of claim 3, wherein the additional accessory is a flashlight, a laser, a camera, a counter, a global positioning system, a range finder, a wind sensor, a display, or an infrared illuminator.

6. The powered mount of claim 1, wherein the power output is a surrogate contact sub-assembly.

7. The powered mount of claim 1, wherein the power output is a port.

8. The powered mount of claim 1, wherein the positive contact sub-assembly includes an insulator and a positive contact, the positive contact for engaging a positive terminal of the battery and transferring electrical current from the battery to the power output.

9. The powered mount of claim 1, further comprising a power conditioning system for conditioning electrical current from an external power source for the optical sight.

10. The powered mount of claim 9, wherein the power conditioning system includes at least one power conditioner having at least one element from the group of a transistor, a diode, a resistor, a capacitor, and an inductor.

11. The powered mount of claim 1, further comprising a power input port configured to electrically connect with an external power source, wherein the battery is electrically connected to the power input port and configured to be recharged by the external power source.

12. The powered mount of claim 3, wherein the second power output is aligned with the positive contact sub-assembly, the negative contact, and the battery along a length of the housing.

13. The powered mount of claim 7, wherein the second surface of the housing includes a channel extending the length of the housing, the channel aligning the optical sight on the second surface, and the port is disposed in the channel.

14. The powered mount of claim 1, wherein the second surface is a flat, planar surface having apertures for receiving fasteners for securing the optical sight to the second surface.

15. The powered mount of claim 14, wherein the second surface includes alignment projections spaced apart from the power output, the alignment projections being configured for aligning the optical sight on the second surface.

* * * * *